US008161980B2

(12) United States Patent
Inoue et al.

(10) Patent No.: US 8,161,980 B2
(45) Date of Patent: Apr. 24, 2012

(54) FRONTAL HAIRPIECE

(76) Inventors: Junichi Inoue, San Francisco, CA (US); Helene Stahl, North Hills, CA (US)

( * ) Notice: Subject to any disclaimer, the term of this patent is extended or adjusted under 35 U.S.C. 154(b) by 252 days.

(21) Appl. No.: 12/700,412

(22) Filed: Feb. 4, 2010

(65) Prior Publication Data

US 2011/0186065 A1 Aug. 4, 2011

(51) Int. Cl.
*A41G 3/00* (2006.01)

(52) U.S. Cl. ..... 132/53

(58) Field of Classification Search ..... 132/201, 132/53–56

See application file for complete search history.

(56) References Cited

U.S. PATENT DOCUMENTS

| | | | | |
|---|---|---|---|---|
| 1,634,190 | A * | 6/1927 | Hepner | 132/53 |
| 3,871,389 | A | 3/1975 | Bauer | |
| 5,607,479 | A | 3/1997 | Jones et al. | |
| 7,343,921 | B2 | 3/2008 | Salinas | |

* cited by examiner

*Primary Examiner* — Rachel Steitz
(74) *Attorney, Agent, or Firm* — Lance M. Pritikin

(57) ABSTRACT

A frontal hairpiece for providing a naturally-appearing augmented frontal hairline when applied to the wearer. A frontal foundation has a forward edge, a rearward edge, a first end and a second end. The frontal foundation is thin, flexible and made from a net-like construction which substantially blends with the skin color of the wearer. The forward edge traces a tortuous pathway from approximately the first end to approximately the second end. Embodiments may include an elastic band portion connected to the frontal foundation, with first and second rear strap portions disposed therebetween. Hair is attached to the frontal foundation in a first density pattern which mimics a natural transition of a wearer's forehead into a frontal hairline. The first density pattern of some embodiments may be characterized by a greater density of hair strands applied proximate the rearward edge of the frontal foundation compared to the density of hair strands applied proximate the forward edge.

12 Claims, 2 Drawing Sheets

FRONTAL HAIRPIECE

RELATED APPLICATIONS

Not Applicable.

TECHNICAL FIELD OF THE INVENTION

The present invention relates generally to the field of hairpieces. More particularly, the invention concerns an improved frontal hairpiece which provides the wearer an augmented frontal hairline that is natural in appearance.

BACKGROUND OF THE INVENTION

A significant percentage of men and women experience the partial or total loss of hair during their lives. One of the first locations where this loss becomes apparent is along the frontal portion of the hairline. Options for making such hair loss less conspicuous generally include undergoing hair transplantation surgery, wearing decorative head coverings such as hats and bandannas, wearing full wigs, and wearing or applying extensions or partial hairpieces.

Partial hairpieces tend to be individually designed for application to a specific portion of the head requiring hair augmentation. Partial hairpieces generally present a cost advantage over full wigs because the manufacturing of partial hairpieces requires less foundation material, less natural or synthetic hair, and less bonding or fastening of hair to the foundation. Partial hairpieces also have an advantage over hair extensions in that partial hairpieces generally do not require anchoring to the wearer's natural hair, which may be too short, sparse or brittle to rely on for effective anchoring support. For an example of such a hair extension apparatus and method of using same, see U.S. Pat. No. 7,343,921, the disclosure of which is hereby incorporated by reference as if fully set forth herein. Frontal "islands" have been applied in a similar manner, as illustrated, in part, in U.S. Pat. No. 3,871,389, the disclosure of which is hereby incorporated by reference as if fully set forth herein.

Frontal hairpieces are a type of partial hairpiece designed to augment the wearer's thinning or lost natural hair toward the front of the scalp. As such, the forward-most part of the frontal hairpiece is typically positioned to form the frontal hairline of the wearer from the viewpoint of the observer. The frontal hairline is where the wearer's hair roots appear to end and the upper edge of the face, or forehead, appears to begin. Those in the art are well aware that making such a frontal hairpiece appear natural and inconspicuous to the observer continues to present a significant challenge. The difficulty in using artificial hairpieces to create a natural frontal hairline is significant enough to motivate some to prefer techniques which employ surgical hair transplantation at the frontal hairline, and an artificial hairpiece only where the typically perceptible edges of the hairpiece would be less noticeable, such as on the top or back of the head. An example of such a technique is disclosed, in part, in U.S. Pat. No. 5,607,479, the disclosure of which is hereby incorporated by reference as if fully set forth herein.

Prior art frontal hairpieces commonly rely on "bangs," or overhanging strands of hair, to drape an otherwise conspicuous artificial frontal hairline from view. Even if the foundation material blends in well with the scalp of the wearer, where the hairline resulting from a frontal hairpiece is left visible, the high density with which hair is applied to the foundation of the hairpiece proximate its forward edge often results in an artificial appearance. This is because natural hairlines typically do not form an abrupt transition from dense hair to a complete lack of hair. Instead, the density of a person's natural hair tends to decrease more gradually as it approaches the hairline from the top of the head. Further, natural hairlines typically trace an uneven, irregular path across the forehead, rather than a perfectly smooth, symmetrical curve.

There exists a need for an inexpensive frontal hairpiece that can be applied by the wearer without the help of a professional hairdresser, presents a more natural-looking hairline and stays in place on the wearer's head.

SUMMARY OF THE INVENTION

By way of summary, the embodiments concern a natural-looking frontal hairpiece that can be applied by the wearer without the assistance of a professional hairdresser.

A frontal foundation has a forward edge, a rearward edge, a first end and a second end. The frontal foundation is made substantially of a net-like construction which is thin and flexible. The net-like construction is formed from a multiplicity of interconnected filaments. The frontal foundation has a multiplicity of individual strands of hair attached thereto in a first density pattern. The forward edge traces a tortuous pathway from approximately the first end to approximately the second end.

In certain embodiments, an elastic band portion is connectedly associated with the first and second ends of the frontal foundation. The elastic band portion has a multiplicity of individual stands of hair attached thereto in a second density pattern. Embodiments further comprise first and second rear strap portions. In such embodiments, the first rear strap portion is connectedly disposed between the first end of the frontal foundation and the elastic band portion. The second rear strap portion is connectedly disposed between the second end of the frontal foundation and the elastic band portion. The first and second rear strap portions each have a multiplicity of individual strands of hair attached thereto in a third density pattern.

In certain embodiments, the first density pattern has a lower average density than the second density pattern and the third density pattern. In further embodiments, the first density pattern comprises fewer strands of hair per square inch proximate the forward edge of the frontal foundation than proximate the rearward edge. In particular embodiments, the first density pattern is adapted to comprise fewer individual strands of hair per square inch than the portion of the wearer's natural hair located approximately adjacent the rearward portion of the frontal foundation when the frontal hairpiece is applied to the wearer.

To help secure the placement of the frontal hairpiece to the wearer's scalp, the frontal foundation is, for example, adapted to be removably affixed to the scalp of the wearer by way of a glue or a thin tape. When they are used, generally the glue or tape are applied at selected tack points at various locations along the frontal foundation between the frontal foundation and the wearer's scalp. In further embodiments, the frontal hairpiece is principally or exclusively secured to the scalp of the wearer by way of an elastic band and rear strap portions. Embodiments which include an elastic band and rear strap portions generally provide the option of also using glue or tape to further secure the frontal hairpiece in place on the wearer.

The detailed description of embodiments of the frontal hairpiece is intended to serve merely as examples, and is in no way intended to limit the scope of the appended claims to these described embodiments. Accordingly, modifications to the embodiments described are possible, and as will be clearly understood by those skilled in the art, the invention may be practiced in many different ways than the embodiments specifically described below, and still remain within the scope of the claims.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
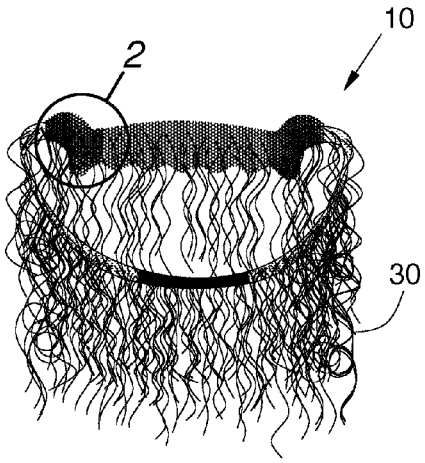
FIG. 1 is diagrammatic front view of an embodiment of a frontal hairpiece.

While the invention is susceptible to various modifications and alternative forms, specific embodiments thereof are shown by way of example in the drawings and may herein be described in detail. The drawings may not be to scale. It should be understood, however, that the drawings and the detailed description thereto are not intended to limit the invention to the particular for disclosed, but to the contrary, the intention is to cover all modifications.

DETAILED DESCRIPTION OF THE INVENTION

Figure 3:
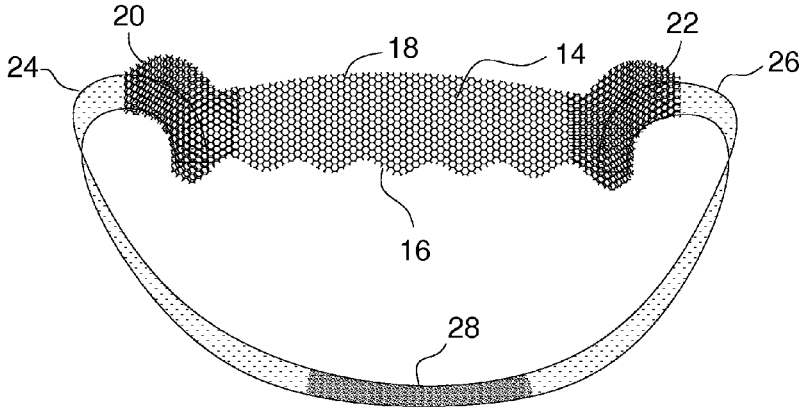
FIG. 3 is a diagrammatic front view of an embodiment of a frontal hairpiece shown without the attached hair so as to better illustrate the structure and interrelationship of the frontal foundation, elastic band portion, and first and second rear strap portions.
Figure 4:
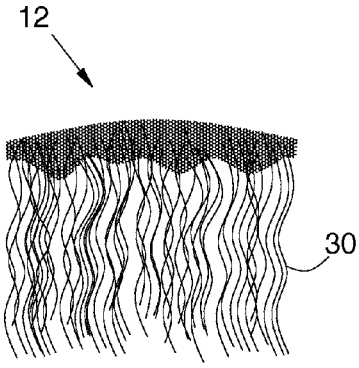
FIG. 4 is diagrammatic front view of an alternate embodiment of a frontal hairpiece.

Referring particularly to the FIGS. for the purposes of illustration of the best modes only, and not limitation, FIG. 1 depicts an embodiment of a frontal hairpiece generally at 10, and FIG. 4 depicts a further embodiment of a frontal hairpiece generally at 12. FIG. 3 illustrates the embodiment of a frontal hairpiece shown generally at 10 prior to receiving the application of hair 30. Frontal foundation 14 has a forward edge 16, a rearward edge 18, a first end 20 and a second end 22.

Frontal foundation 14 possesses one or more features, depending on the particular embodiment, that make it less conspicuous to an observer. As illustrated, for example, in FIGS. 2, 3 and 5, frontal foundation 14 is made substantially of a net-like construction which is thin and flexible. This net-like construction is also generally selected to have the same or similar color as either the skin of the wearer, the color of the attached hair 30, or a further color that best visually obscures the frontal foundation when in close proximity to both the wearer's skin color and the attached hair 30. In embodiments, the net-like construction is generally formed from a multiplicity of interconnected filaments, the color of which is typically selected to be similar to that of the skin of the wearer. The interstices between the filaments are large enough compared to the thickness of the individual filaments to allow the wearer's natural skin color to substantially show through the frontal foundation. Additionally, in embodiments, forward edge 16 traces a tortuous pathway from approximately first end 20 to second end 22. This tortuous pathway may be defined by, for example, a wavy, jagged, or multi-arcuate shape. Each of these characteristics individually contributes to the reduction in observability of the frontal foundation, thus resulting in a more natural-looking augmented frontal hairline.

Turning now to FIG. 3, in certain embodiments, elastic band portion 28 is connected to first end 20 and second end 22, typically by way of first rear strap portion 24 and second rear strap portion 26, respectively. As illustrated in FIG. 3, and in greater detail in FIG. 2, to provide additional reinforcement at the connection locations while ensuring the frontal foundation 14 remains inconspicuous, frontal foundation 14 may include one or more additional layers of net-like construction at generally first end 20 and second end 22. Further, the connections may follow a more curved path to provide a greater area of connectivity without impinging on portions of the frontal foundation 14 that are likely to be visible to the average observer.

Rear strap portions 24 and 26 are generally significantly less elastic than frontal foundation 14 and elastic band portion 28, and reside generally proximate the wearer's temples, or further behind the wearer's head, when frontal hairpiece 10 applied to the wearer. In embodiments comprising elastic band portion 28, when the wearer has applied frontal hairpiece 10, elastic band portion 28 is placed behind the head of the wearer roughly opposite the location of the frontal foundation.

Figure 2:
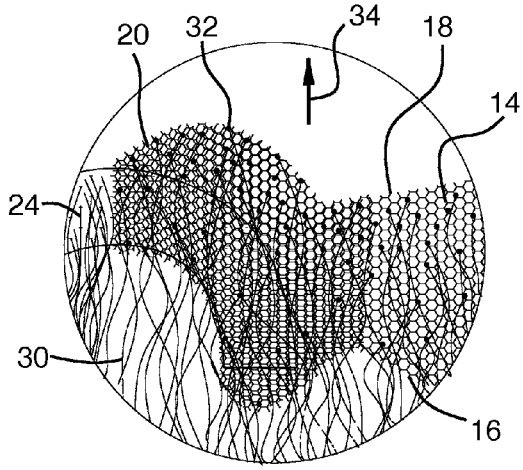
FIG. 2 is a diagrammatic enlarged partial view of detail 2 of FIG. 1.
Figure 6:
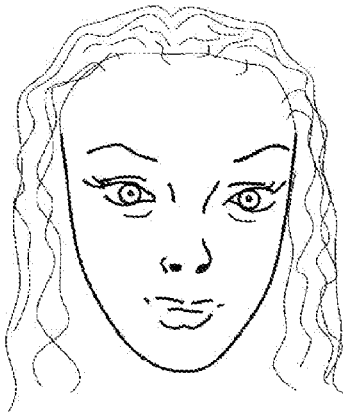
FIG. 6 is a diagrammatic front view of a wearer of a frontal hairpiece according to the present invention prior to application of the frontal hairpiece, illustrating a wearer's natural hairline which has receded and become sparse.
Figure 7:
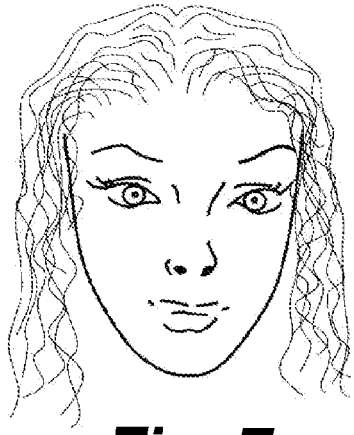
FIG. 7 is diagrammatic front view of the wearer depicted in FIG. 6 after a frontal hairpiece according to the present invention has been applied, illustrating a resulting hairline which is both advanced forward and natural in appearance.

Returning to FIG. 2, frontal foundation 14 has a multiplicity of individual strands hair 30 attached thereto in a first density pattern. The first density pattern provides a more sparse distribution of strands of hair 30 attached to frontal foundation 14 than would typically be found, for example, on the remainder of the wearer's head prior to hair loss. Hair 30 is shown attached to frontal foundation 14 at a plurality of attachment points (see 32, for example). Attachment points 32 are generally shown in FIG. 2 as small dots distributed across the face of frontal foundation 14. Such reduced hair density, particularly toward forward edge 16, provides for a more subtle transition from the bare skin of the wearer's forehead to the augmented hairline resulting from the use of frontal hairpiece 10 or 12. Since natural hairlines commonly do not form an abrupt transition from a bare forehead to densely rooted hair, the lower average density of the first density pattern can significantly contribute to a more natural-looking augmented frontal hairline. FIG. 6 illustrates a wearer prior to the application of frontal hairpiece 10 or 12. FIG. 7 illustrates the wearer with frontal hairpiece 10 or 12 applied.

In further embodiments, the first density pattern of frontal foundation 14 comprises greater strands of hair 30 per square inch proximate rearward edge 18 than proximate forward edge 16. This particular configuration is depicted in FIG. 2, where the density of attachment points 32 gradually increases in direction 34, that is, from forward edge 16 to rearward edge 18. The increased the density of attachment points 32 (and as a result, the increased density of hair 30) toward rearward edge 18 as compared to forward edge 16, allows frontal hairpiece 10 to blend more naturally with the wearer's own hair.

Figure 8:
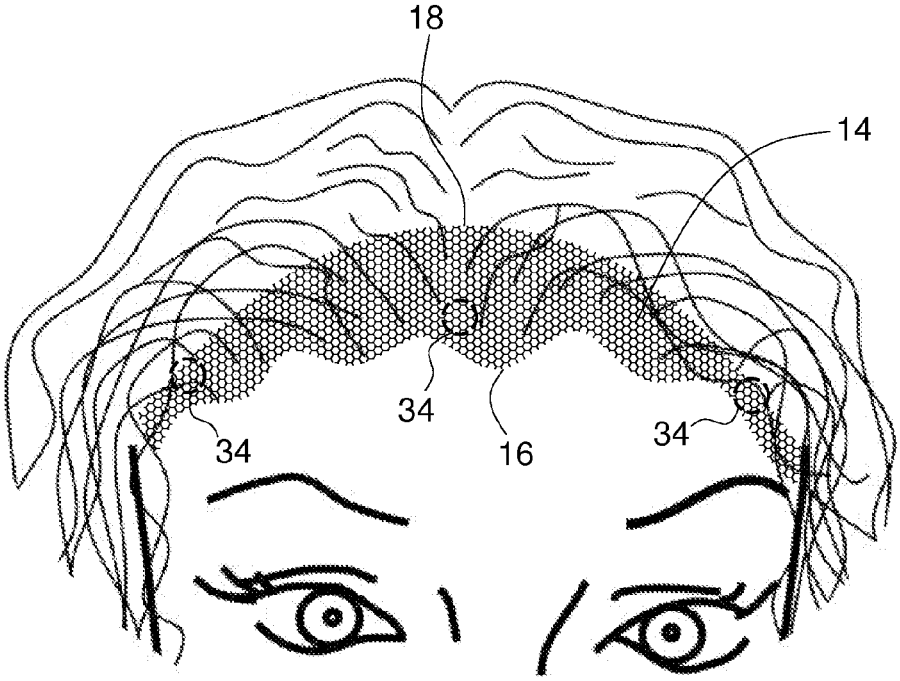
FIG. 8 is an enlarged fragmentary view of the wearer depicted in FIG. 7, showing the orientation of the frontal foundation on the wearer's scalp and the glue tacks or tape points which aid in securing the frontal hairpiece in place.

In embodiments such as the one generally shown in FIG. 1 at 10, hair 30 is attached to elastic band portion 28 in a second density pattern, and to first rear strap portion 24 and second rear strap portion 26 in a third density pattern. In such embodiments, the first density pattern generally has fewer strands of hair 30 applied per square inch than each of the second and third density patterns. When the frontal hairpiece 10 is applied to the wearer, the hair 30 attached to elastic band portion 28, first rear strap portion 24 and second rear strap portion 26, is typically blended with the wearer's natural hair, in part to visually conceal the straps and elastic band. As illustrated, for example, in FIG. 8, a glue or a thin tape can be applied at multiple tack points 34 to help secure frontal foundation 14 to the head of the wearer. The number, size and placement of tack points 34 can vary depending on the particular wearer, size of frontal foundation 14, or the activity the wearer expects be involved in while wearing the frontal hairpiece.

Figure 5:
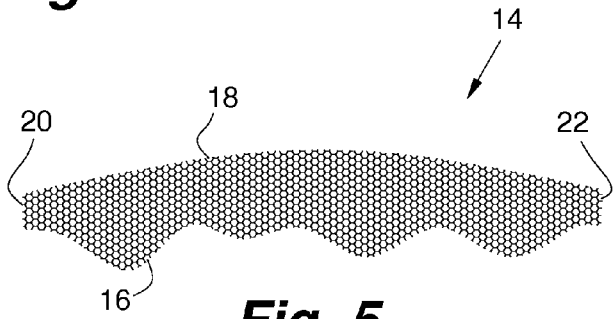
FIG. 5 is a diagrammatic front view of an embodiment of FIG. 4 shown without the attached hair so as to better illustrate the structure of the frontal foundation.

Turning now to FIGS. 4 and 5, a further embodiment of a frontal hairpiece 12 comprises frontal foundation 14 and hair 30 attached thereto in a first density pattern identical to the first density pattern previously described herein with respect to the embodiment of a frontal hairpiece depicted at 10. Returning to FIG. 8 for illustration, an embodiment lacking rear strap portions and an elastic band portion generally necessitates the application of a glue or a thin tape at multiple tack points 34 to help secure frontal foundation 14 to the scalp of the wearer.

The foregoing detailed description of the invention is intended to be illustrative and is not intended to limit the scope of the invention. Changes and modifications are possible with respect to the embodiments detailed in the foregoing descriptions, and it is understood that the invention may be practiced otherwise than that specifically described herein and still be within the scope of the appended claims.

What is claimed is:

1. A frontal hairpiece for creating the appearance of a natural frontal hairline when applied to a wearer, said frontal hairpiece comprising:

a frontal foundation having a forward edge, a rearward edge, a first end and a second end, said frontal foundation being made substantially of a net-like construction which is thin and flexible, said net-like construction being formed from a multiplicity of interconnected filaments, said frontal foundation having a multiplicity of individual strands of hair attached thereto in a first density pattern, said forward edge tracing a tortuous pathway from approximately said first end to approximately said second end;

an elastic band portion being connectedly associated with said first end and said second end, said elastic band portion having a multiplicity of individual stands of hair attached thereto in a second density pattern; and a first rear strap portion and a second rear strap portion, said first rear strap portion being connectedly disposed between said first end and said elastic band portion, said second rear strap portion being connectedly disposed between said second end and said elastic band portion, said first and second rear strap portions each having a multiplicity of individual strands of hair attached thereto in a third density pattern.

2. A frontal hairpiece as defined in claim 1 in which said first density pattern has a lower average density than each of said second density pattern and said third density pattern.

3. A frontal hairpiece as defined in claim 1 in which said first density pattern comprises fewer strands per square inch proximate said forward edge than proximate said rearward edge.

4. A frontal hairpiece as defined in claim 1 in which said frontal foundation is adapted to be removably affixed to the scalp of a wearer by way of a glue.

5. A frontal hairpiece as defined in claim 1 in which said frontal foundation is adapted to be removably affixed to the scalp of a wearer by way of a thin tape.

6. A frontal hairpiece as defined in claim 1 in which said frontal foundation includes multiple layers of said net-like construction at generally said first end and generally said second end.

7. A frontal hairpiece as defined in claim 1 in which said first strap portion and said first end are fixedly connected along a generally curved path, and said second strap portion and said second end are fixedly connected along a generally curved path.

8. A frontal hairpiece for creating the appearance of a natural frontal hairline when applied to a wearer, said frontal hairpiece comprising:

a frontal foundation having a forward edge, a rearward edge, a first end and a second end, said frontal foundation being made substantially of a net-like construction which is thin and flexible, said net-like construction being formed from a multiplicity of interconnected filaments, said frontal foundation having a multiplicity of individual strands of hair attached thereto in a first density pattern, said forward edge tracing a tortuous pathway from approximately said first end to approximately said second end;

an elastic band portion being connectedly associated with said first end and said second end, said elastic band portion having a multiplicity of individual stands of hair attached thereto in a second density pattern, said second density pattern having a higher average density than said first density pattern; and a first rear strap portion and a second rear strap portion, said first rear strap portion being connectedly disposed between said first end and said elastic band portion, said second rear strap portion being connectedly disposed between said second end and said elastic band portion, said first and second rear strap portions each having a multiplicity of individual strands of hair attached thereto in a third density pattern, said third density pattern having a higher average density than said first density pattern.

9. A frontal hairpiece as defined in claim 8 in which said first density pattern comprises a lower number of individual strands of hair per square inch proximate said forward edge than proximate said rearward edge.

10. A frontal hairpiece as defined in claim 8 in which said frontal foundation includes multiple layers of said net-like construction at generally said first end and generally said second end.

11. A frontal hairpiece as defined in claim 8 in which said first strap portion and said first end are fixedly connected along a generally curved path, and said second strap portion and said second end are fixedly connected along a generally curved path.

12. A frontal hairpiece for creating the appearance of a natural frontal hairline when applied to a wearer, said frontal hairpiece comprising:

a frontal foundation having a forward edge, a rearward edge, a first end and a second end, said frontal foundation being made substantially of a net-like construction which is thin and flexible, said net-like construction being formed from a multiplicity of interconnected filaments, said frontal foundation having a multiplicity of individual strands of hair attached thereto in a first density pattern, said first density pattern comprising a lower number of individual strands of hair per square inch proximate said forward edge than proximate said rearward edge, said forward edge tracing a tortuous pathway from approximately said first end to approximately said second end, said first density pattern being adapted to comprise fewer individual strands of hair per square inch than the portion of said wearer's natural hair located approximately adjacent said rearward portion when said frontal hairpiece is applied to said wearer.

* * * * *